US006783046B2

(12) United States Patent
Toulouse

(10) Patent No.: US 6,783,046 B2
(45) Date of Patent: Aug. 31, 2004

(54) SECURING DEVICE INVOLVING A PISTON PROPELLED BY COMPRESSED GAS

(75) Inventor: Bruno Toulouse, Valence (FR)

(73) Assignee: Societe de Prospection et d'Inventions Techniques SPIT (FR)

( * ) Notice: Subject to any disclaimer, the term of this patent is extended or adjusted under 35 U.S.C. 154(b) by 0 days.

(21) Appl. No.: 10/299,827

(22) Filed: Nov. 20, 2002

(65) Prior Publication Data

US 2003/0094148 A1 May 22, 2003

(30) Foreign Application Priority Data

Nov. 21, 2001 (FR) ..... 01 15052

(51) Int. Cl.[7] ..... B25C 1/14
(52) U.S. Cl. ..... 227/10; 123/46 SC
(58) Field of Search ..... 227/10, 130; 123/46 SC; 239/337, 338

(56) References Cited

U.S. PATENT DOCUMENTS 4,522,162 A 6/1985 Nikolich
5,263,439 A * 11/1993 Doherty et al. ..... 123/46 SC
5,680,980 A * 10/1997 Robinson ..... 227/10
5,752,643 A * 5/1998 MacVicar et al. ..... 227/10
5,971,245 A * 10/1999 Robinson ..... 227/10
6,102,270 A 8/2000 Robinson
6,123,241 A * 9/2000 Walter et al. ..... 227/8

FOREIGN PATENT DOCUMENTS

EP 0 424 941 A1 10/1990
EP 1 093 887 A2 4/2001
EP 1 093 888 A2 4/2001

* cited by examiner

*Primary Examiner*—Scott A. Smith
(74) *Attorney, Agent, or Firm*—Lowe Hauptman Gilman & Berner LLP

(57) ABSTRACT

A device for securing a plug, of the type involving a piston (9) propelled by gas, has a combustion chamber (5) delimited on one side by the piston and on the other side by a cylinder head (7) with a duct (19) for injecting combustible gas open via one end (19A) into the chamber. The duct (19) has an orifice for creating a pressure drop between the part of the duct (19) upstream of the end (19A) and the chamber (5) itself, so as to at least partially avoid the vaporizing of the combustible gas in the part of the duct upstream of the end.

20 Claims, 1 Drawing Sheet

SECURING DEVICE INVOLVING A PISTON PROPELLED BY COMPRESSED GAS

FIELD OF THE INVENTION

The invention relates to a device for securing a plug with a motor involving a piston propelled by gas, particularly combustion gases. It is aimed in particular at a means improving the combustion inside the chamber in which the gases are produced.

BACKGROUND OF THE INVENTION

A device of this type comprises a casing which has the overall form of a gun. This casing contains a small internal combustion engine which drives a plug guide in a translation movement. The plug guide is secured to a piston propelled by a compressed gas which is the product of the combustion of a combustible gas in the adjoining combustion chamber. The gaseous mixture comprising the air and the combustible gas is created in the chamber then ignited by an appropriate ignition means. The gun comprises a combustible-gas cartridge housed, for example, in the hand grip. When a plug is fired, a metered amount of combustible gas is sent into the chamber, then voltage is applied to the firing means. In devices known to the applicant company, the gas follows a path along the device from a metering valve near the gas cartridge to the combustion chamber. The gas is guided along a duct, generally a fine tube, arranged between the valve and the chamber.

With the devices found on the market, it is observed that there is a significant delay between the time of firing and the actual ejection of the plug. This delay may prove troublesome when the operator is in an uncomfortable position and the device is likely to move.

SUMMARY OF THE INVENTION

An object of the invention is to reduce the reaction time as far as possible.

According to the invention, this result is achieved by incorporating a means that creates a pressure drop between the part of the tube upstream of its end near the combustion chamber and the chamber itself, so as to at least partially avoid the vaporizing of the gas upstream of the said end.

Such a means consists of a narrowing of the tube at its end, the tube has a side orifice.

What happens is that the gas is normally in the liquid state in the cartridge, and experiences expansion as it leaves the metering valve. It has been observed that, surprisingly, if the time of its vaporization prior to entering the chamber is delayed, the time that the device takes to react the squeezing of the trigger is reduced.

This result can be explained by the fact that there is a link between the vaporizing of the gas as it passes through the metered valve, and the time taken to fill the combustion chamber. With devices of the prior art, the time is relatively long. By contrast, with the solution of the invention, the gas is propelled in greater quantity and in a shorter time because it remains partially in the liquid state immediately upstream of the atomization orifice. The cycle time is thus reduced.

According to another characteristic, the cross section of the orifice or of the orifices is at least 10% less than the cross section of the duct.

BRIEF DESCRIPTION OF THE DRAWINGS

Other characteristics and advantages of the invention will become apparent from reading the description which follows, which relates to one particular embodiment of a device, with reference to the appended drawings in which.

DETAILED DESCRIPTION OF THE INVENTION

Figure 1:
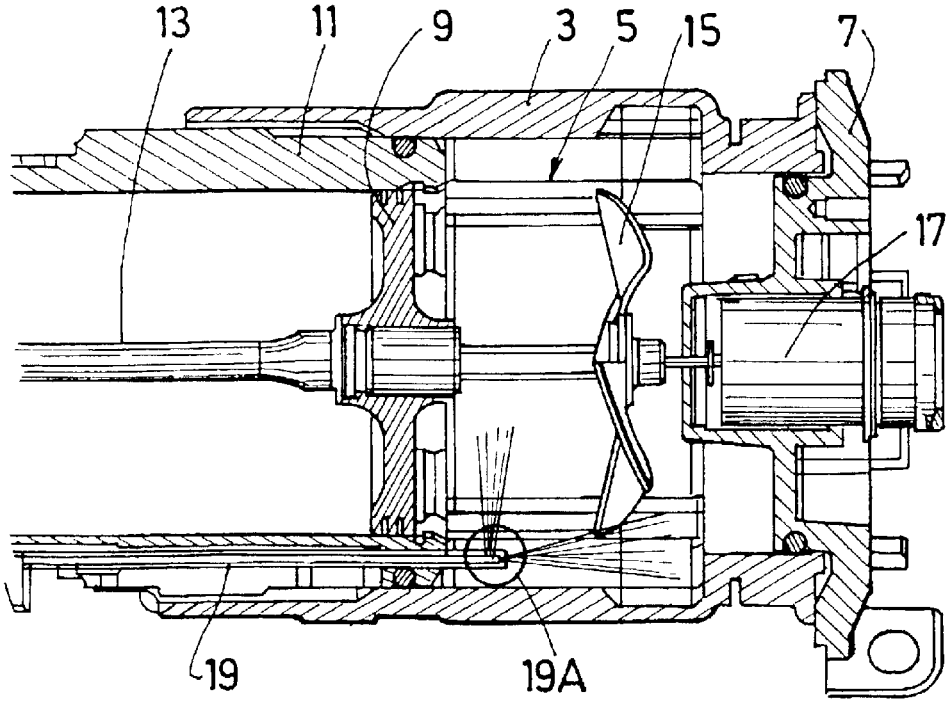
FIG. 1 depicts a part view in axial section of the device

FIG. 1 shows the rear end of the device 1 without its case. The sleeve 3 of the combustion chamber 5, closed by a cylinder head 7 on one side and by a piston 9 on the other side may be seen. The piston 9 moves in translation in a cylinder 11 and is secured to a rod 13. This rod rests at its other end, not depicted, against a plug that is to be propelled. A blower 15 is mounted inside the chamber 5 and its function is to activate the mixing of the gases. It is driven by a motor 17 housed in the cylinder head 7. Its axis of rotation here lies in the continuation of the rod 13. The gaseous mixture is ignited by a means which has not been depicted and which lies in the region of the cylinder head, behind the blower.

A gas injection tube or duct opens into the combustion chamber. Its axis is roughly parallel to that of the rod 13. It is connected at its other end, not visible in the figure, to the metering valve. The latter is arranged in a housing of the device which is designed for that purpose.

Figure 2:
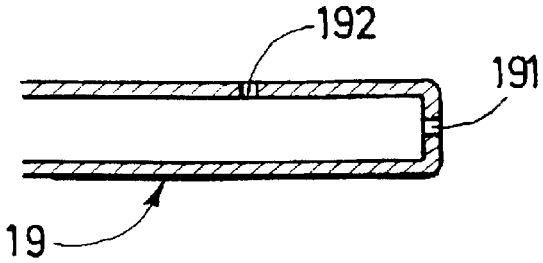
FIG. 2 shows one example of the end of the chamber supply tube.

FIG. 2 depicts an embodiment of the end 19A of the injection tube. This end shows an axial first orifice 191 which allows injection in the continuation of the duct 19 towards the blades of the blower. It also comprises an orifice 192. This orifice is placed on the wall of the tube 19 for radial injection parallel to the plane of the piston 9. According to the invention, the total of the cross sections of the orifices is less than the cross section of the tube, so as to create a pressure drop between the tube and the combustion chamber.

According to another embodiment, the tube is closed at its end via a transverse wall and has only openings made in the wall, laterally.

A tube according to the invention was made and used to replace the tube of an existing device.

The characteristic dimensions were as follows:

Internal cross section of the tube: 1.00 units (of area).

Cross section of the axial circular orifice: 0.35 unit.

Cross section of the lateral circular orifice: 0.50 unit.

The narrowing of the cross section of the duct was therefore 15%.

Comparative tests were carried out comparing the solution of the invention with that of the prior art. It was found that it was thus possible to increase for a firing rate of one shot per second to two shots per second without making any other modifications.

What is claimed is:

1. A device for driving a plug, said device comprising:

a cylinder having a cylinder head;

a piston moveable within the cylinder;

a combustion chamber defined between the piston and the cylinder head; and a duct for injecting combustible gas, via an open end of the duct, into the chamber, wherein the open end of the duct comprises a lateral orifice having a cross sectional area narrower than that of the duct for creating a pressure drop between a part of the duct upstream of said open end and the chamber, so as to at least partially avoid vaporization of the combustible gas in said part of the duct upstream of the open end; and an axial orifice directed in a direction different from that of the lateral orifice.

2. The device according to claim 1, wherein a sum of the cross sectional areas of the orifices is at least 10% smaller than the cross sectional area of the duct.

3. The device according to claim 1, further comprising a blower for mixing the combustible gas inside the combustion chamber, the duct comprising at least one orifice oriented to direct at least a portion of the combustible gas injected into the chamber toward the blower.

4. The device according to claim 1, wherein the lateral orifice is directed in a direction parallel to a plane of the piston.

5. The device according to claim 1, wherein the duct extends substantially parallel to an axial direction of the cylinder along which the piston is adapted to reciprocate, said axial orifice being directed in said axial direction, and said lateral orifice being directed transversely of said axial direction.

6. The device according to claim 1, wherein the cross sectional area of said axial orifice is about 35% of the cross sectional area of the duct, and the cross sectional area of said lateral orifice is about 50% of the cross sectional area of the duct.

7. An internal combustion tool for driving a plug, said tool comprising:

a combustion chamber in which a combustible gas is to be combusted to provide energy that drives the plug; and a duct for introducing the combustible gas into the chamber;

wherein the duct has a portion located within said chamber;

said portion has a lateral orifice formed in a side wall of said portion of said duct; and said lateral orifice has an opening area smaller than a cross sectional area of said duct in said portion.

8. The tool of claim 7, further comprising an axial orifice formed at a terminal end of said portion of said duct.

9. The tool of claim 8, wherein a sum of the opening area of the lateral orifice and an opening area of the axial orifice is at least 10% smaller than the cross sectional area of the duct in said portion.

10. The tool of claim 8, further comprising a blower for mixing the combustible gas inside the combustion chamber, said axial orifice being oriented to direct at least a portion of the combustible gas injected into the chamber toward the blower.

11. The tool of claim 8, wherein the axial orifice is directed in an axial direction of said portion of said duct and said lateral orifice is directed transversely of said axial direction.

12. The tool of claim 8, wherein the opening area of said axial orifice is smaller than the opening area of said lateral orifice.

13. The tool of claim 7, wherein said portion of said duct comprises multiple orifices, including said lateral orifice, for introducing the combustible gas into said chamber;

a sum of opening areas of all said orifices is smaller than the cross sectional area of said duct in said portion.

14. The tool of claim 13, wherein said sum of the opening areas of all said orifices is at least 10% smaller than the cross sectional area of said duct in said portion.

15. The tool of claim 7, wherein said portion of said duct comprises said side wall that defines the cross sectional area of said duct in said portion and a transverse wall that defines a terminal end of said portion of said duct;

said lateral orifice is spaced from said transverse wall in an axial direction of said duct in said portion; and said portion of said duct further comprises an axial orifice formed in said transverse wall.

16. The tool of claim 7, wherein said portion of said duct comprises said side wall that defines the cross sectional area of said duct in said portion and a transverse wall that closes off said duct; and said lateral orifice is spaced from said transverse wall in an axial direction of said duct in said portion.

17. An internal combustion tool for driving a plug, said tool comprising:

a combustion chamber in which a combustible gas is to be combusted to provide energy that drives the plug;

first means for delivering the combustible gas from a combustible gas cartridge, where said combustible gas is stored in a liquid state, into said chamber; and second means for creating a pressure drop between the first means and the chamber, thereby delaying vaporization of said combustible gas being delivered to said chamber by said first means.

18. The tool of claim 17, wherein said second means is located within said chamber.

19. The tool of claim 17, wherein said first means includes a tube having a substantially constant cross section, and said second means includes at least one orifice formed through a wall of said tube, an opening area of said at least one orifice being smaller than an area of said cross section of said tube.

20. The tool of claim 17, wherein said first means includes a tube having a substantially constant cross section and being in fluid communication with the chamber through a number of orifices that define said second means;

a sum of opening areas of all said orifices, through which the tube is communicated with the chamber, being smaller than an area of said cross section of said tube.

* * * * *